US011643783B2

(12) United States Patent
Stancescu

(10) Patent No.: US 11,643,783 B2
(45) Date of Patent: May 9, 2023

(54) SIMPLIFIED STEEL ORTHOTROPIC DECK BRIDGE PANEL

(71) Applicant: Samuel, Son & Co., Limited, Mississauga (CA)

(72) Inventor: Daniel Stancescu, Toronto (CA)

(73) Assignee: Samuel, Son & Co., Limited, Mississauga (CA)

( * ) Notice: Subject to any disclaimer, the term of this patent is extended or adjusted under 35 U.S.C. 154(b) by 83 days.

(21) Appl. No.: 17/169,634

(22) Filed: Feb. 8, 2021

(65) Prior Publication Data

US 2021/0301483 A1 Sep. 30, 2021

Related U.S. Application Data

(60) Provisional application No. 62/994,114, filed on Mar. 24, 2020.

(51) Int. Cl.
*E01D 19/12* (2006.01)
*E01D 21/00* (2006.01)
*E01D 101/30* (2006.01)

(52) U.S. Cl.
CPC ..... *E01D 19/125* (2013.01); *E01D 21/00* (2013.01); *E01D 2101/30* (2013.01)

(58) Field of Classification Search
CPC .... E01D 19/125; E01D 21/00; E01D 2101/30
USPC ..... 14/73–78
See application file for complete search history.

(56) References Cited

U.S. PATENT DOCUMENTS 3,302,361 A * 2/1967 Oudheusden, Jr. ... E01D 19/125 52/798.1
3,812,636 A * 5/1974 Albrecht ..... E04D 3/30 52/630
4,282,619 A * 8/1981 Rooney ..... E01D 2/04 52/693
4,706,319 A * 11/1987 Sivachenko ..... E01D 19/103 14/73
5,339,475 A * 8/1994 Jaeger ..... E04B 5/29 404/70
5,501,053 A * 3/1996 Goleby ..... E04C 3/07 29/897.3
7,069,614 B1 * 7/2006 Sivachenko ..... E01D 2/00 52/579

(Continued)

OTHER PUBLICATIONS

TEGcivil, "CONstruct Prefabricated Bridge System," Product literature posted at www.constructbridge.com at least as early as Jun. 6, 2019.

(Continued)

*Primary Examiner* — Raymond W Addie
(74) *Attorney, Agent, or Firm* — Hodgson Russ LLP

(57) ABSTRACT

A cost-effective orthotropic deck bridge panel which is capable of being standardized to facilitate the use of orthotropic decks on short span bridges. Inclusion of a concrete deck in the panel simplifies fabrication details, thereby increasing the economic viability of the disclosed orthotropic deck panel in short span bridge projects. Shortcomings in fabrication of steel support ribs of the panel are overcome by using a cold roll-forming process instead of a press brake to form longitudinal bends in sheet material. The cold roll-forming process further allows camber to be introduced in the support ribs, thereby eliminating an extra manufacturing step.

11 Claims, 1 Drawing Sheet

(56) References Cited

U.S. PATENT DOCUMENTS

Figure 1:
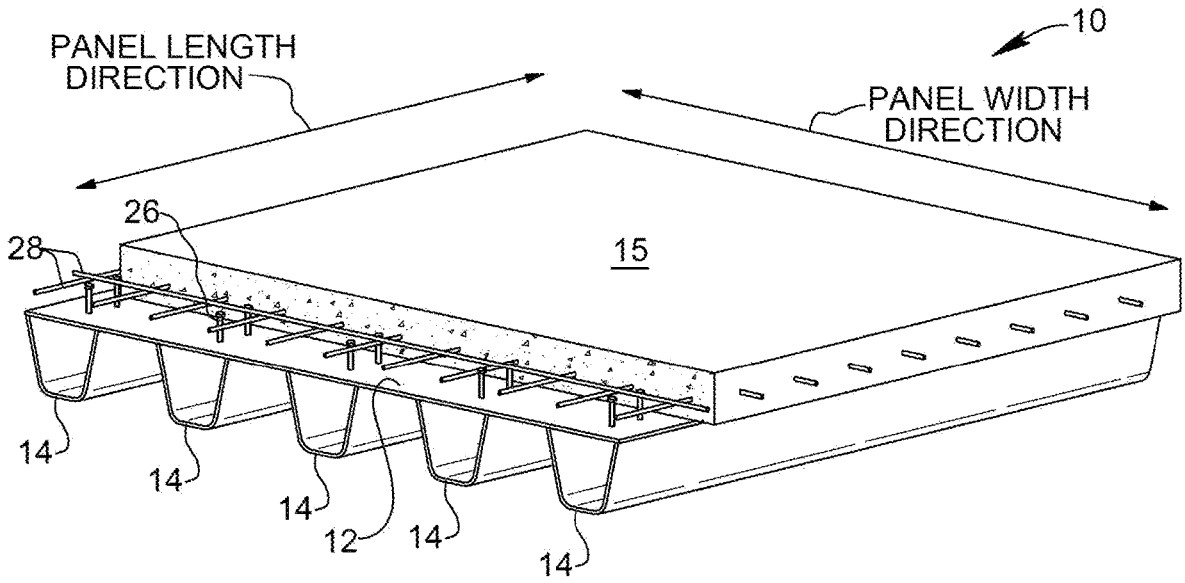

| | | | | |
|---|---|---|---|---|
| 2002/0104355 | A1* | 8/2002 | Patty | B21D 5/08 72/176 |
| 2006/0162102 | A1* | 7/2006 | Nelson | E01D 2/02 14/77.1 |
| 2006/0207212 | A1* | 9/2006 | Durney | E04C 3/32 52/846 |
| 2007/0000077 | A1* | 1/2007 | Wilson | E01D 19/125 14/73 |
| 2007/0000197 | A1* | 1/2007 | Patrick | E04B 5/29 52/434 |

OTHER PUBLICATIONS

Amercian Institute of Steel Construction, Inc., "Design Manual for Orthotropic Steel Plate Deck Bridges," 1963, New York, U.S.A.

United States Department of Transportation, Federal Highway Administration, "Manual for Design, Construction, and Maintenance of Orthotropic Steel Deck Bridges," Publication No. FHWA-IF-12-027, Feb. 2012.

United States Department of Transportation, Federal Highway Administration, "Optimization of Rib-to-Deck Welds for Steel Orthotropic Bridge Decks," Publication No. FHWA-HRT-17-020, Feb. 2017.

* cited by examiner

SIMPLIFIED STEEL ORTHOTROPIC DECK BRIDGE PANEL

FIELD OF THE DISCLOSURE

The present disclosure relates to steel orthotropic deck panels used in building bridges.

BACKGROUND OF THE DISCLOSURE

Currently, orthotropic deck panels for constructing bridges are fabricated by welding a series of steel ribs to the underside of a flat steel deck plate so that the ribs extend parallel to one another in a longitudinal direction of the deck panel. The prevailing use for current orthotropic designs is on high traffic volume, long span bridges (i.e. bridges having a span of 140 feet or more), where a reduction in deadload is the focus. This convergence of designing for high-volume roads and a focus on least weight creates complex fabrication requirements. For example, to prevent fatigue cracking of rib to deck plate welds, strict quality control measures are necessary during welding and subsequent inspection. Nevertheless, an orthotropic deck fabricated from steel is an economically efficient system for reducing deadload weight on long span bridges, and has longer life span compared to concrete bridges.

By contrast, the short span bridge market (i.e. bridges having a span less than 140 feet) is defined by cost sensitivity, minimization of structural depth, and ease of construction. The complex geometries, tight tolerances, and detailed welding procedures for fabricating orthotropic decks make them economically unviable for short span bridges, where competing structure types such as concrete slab and box beam decks offer better overall economics. The Average Daily Traffic (ADT) for short span bridges is 7,533 vehicles per day, whereas the ADT for long span bridges is 22,245 vehicles per day.

In current orthotropic decks, the ribs are fabricated using a press brake to form longitudinal bends in a length of steel sheet material. For example, in the case of a closed trapezoidal rib, a pair of parallel longitudinal bends are formed by the press brake to define a bottom wall and a pair of side walls extending from opposite sides of the bottom wall. This current fabrication technique has shortcomings. One shortcoming is that the overall length of commercial press brakes is limited, so the overall rib length is limited to about 60 feet. Another shortcoming is that camber cannot be induced during the press brake operation. Camber adds extra structural support and is used with the purpose of counteracting deflection due to load. Finally, use of a press brake to form the rib segments means that additional manufacturing steps are needed to bend and to introduce camber into the ribs. In these conditions the manufacturing cost makes the steel press brake rib financially non-competitive with the similar concrete products.

SUMMARY OF THE DISCLOSURE

The present disclosure provides a cost-effective orthotropic deck bridge panel which is capable of being standardized to facilitate the use of orthotropic decks on short span bridges.

The inclusion of a concrete deck is a notable difference between the orthotropic deck panel of the present disclosure and known orthotropic deck designs. Inclusion of a concrete deck simplifies fabrication details, thereby increasing the economic viability of the disclosed orthotropic deck panel in the short span bridge market.

The present disclosure also overcomes the shortcomings in rib fabrication mentioned above by using a cold roll-forming process instead of a press brake to form the longitudinal bends in the sheet material. Both press brake forming and cold roll-forming provide straight bend lines. During brake forming, the cross section is changed along the full length of the product during one instant impact inducing major stresses in the bends and their nearby vicinity. Cold roll-forming, however, is a progressive process. While one end of the strip is flat, the other end is completely formed; so, limited to non-existent stresses are introduced. As a result, each rib can be made as a unitary (i.e. one-piece) part of much greater length than is currently available using a press brake, thereby avoiding end-to-end welding of shorter rib sections. The raw material supply and the final product (rib) may be any length up to the maximum length allowed for shipping transport, estimated between 90 and 110 feet. Camber can be introduced in a controlled manner during the cold roll-forming process. Moreover, the inner radius of each roll-formed bend can be about 1½ to 2 times the material thickness, which is much less than the inner radius possible with a press brake.

BRIEF DESCRIPTION OF THE DRAWING VIEWS

Figure 2:
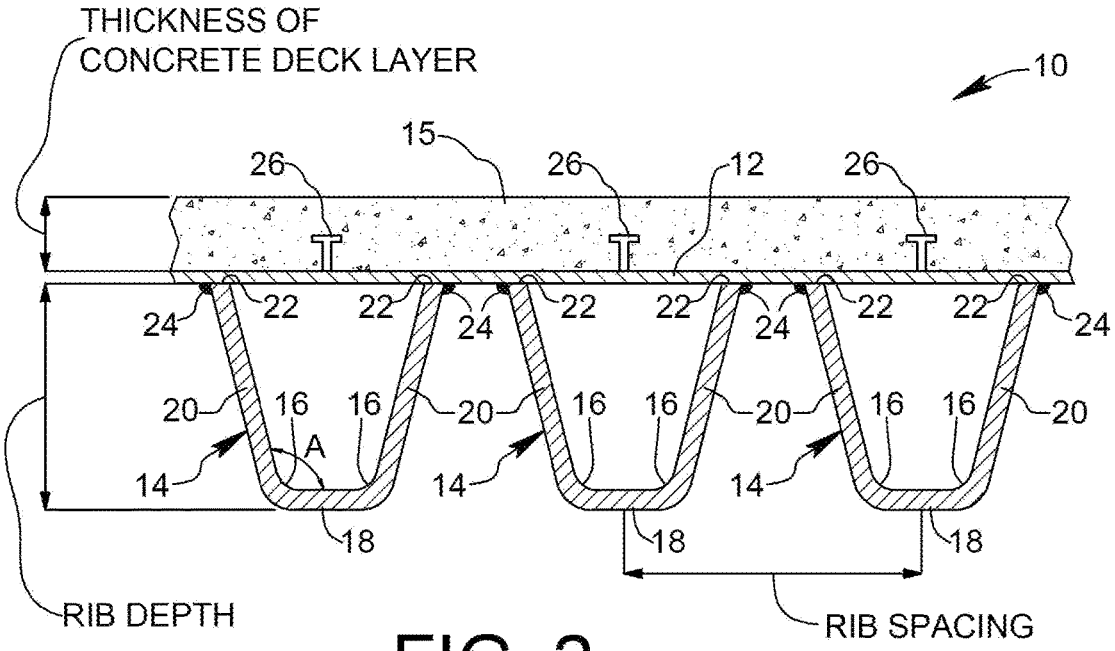

The nature and mode of operation of the present disclosure will now be more fully described in the following detailed description taken with the accompanying drawing figures, in which:

FIG. 1 is a perspective view of an orthotropic deck panel manufactured in accordance with an embodiment of the present disclosure; and FIG. 2 is a partial cross-sectional view thereof.

DETAILED DESCRIPTION

FIGS. 1 and 2 show an orthotropic deck panel 10 manufactured in accordance with an embodiment of the present disclosure. Deck panel 10 may be used in constructing a short span bridge.

Deck panel 10 generally comprises a flat deck plate 12, a plurality of elongated ribs 14 welded to an underside of deck plate 12, and a concrete deck layer 15 applied to a topside of deck plate 12.

In the depicted embodiment, deck plate 12 is formed of ½-inch thick steel plate, for example ASTM A709 Grade 50 or ASTM A709 HPS70W steel plate. Other thicknesses and steel grades may be used to form deck plate 12. The illustrated deck plate 12 may be 120 inches (10 feet) wide, and may have any suitable length. Due to shipping limitations, any length up to 90 feet is commercially viable. Other length and width dimensions may be used for deck plate 12 to suit the needs of the bridge deck design.

Each rib 14 includes a pair of bends 16 extending in a longitudinal direction of the rib, a bottom wall 18 between bends 16, and a pair of side walls 20 each extending from a respective one of the bends 16 and terminating at a corresponding edge 22. Bends 16 are formed by passing sheet material through a roll-forming machine including a series of roll-forming stations having rollers which are set up to engage the sheet material and progressively form each bend 16 as the sheet material advances through the roll-forming machine from one station to the next. The sheet material for ribs 14 may be a desired thickness allowing roll-forming, a desired width for achieving the desired rib dimensions (e.g. rib depth, bottom wall width, and bend angles), and the may be cut to a desired length before or after the sheet material is roll-formed into rib 14. For example, the sheet material for ribs 14 may be ASTM A709 Grade 50 or ASTM A709 HPS70W steel plate having a thickness of 0.5 inches. The inner radius of each bend 16 is at least two time the thickness (e.g., for rib plate having a thickness of 0.5 inches, the minimum radius is at least 1.0 inches). Each bend 16 forms an included angle A between bottom wall 18 and the corresponding side wall 20. For example, in the illustrated embodiment, included angle A is 97.0°, however the included angle A is subject to design choice and other angles may be used. The rib depth is subject to variation to meet design criteria. By way of non-limiting example, a rib depth on the order of between twelve inches and eighteen inches may be used.

Ribs 14 may be affixed to an underside surface of deck plate 12 by longitudinal welds 24 provided along each edge 22 and the underside surface of deck plate 12. Edges 22 may be beveled to rest in flush surface-to-surface engagement with the underside surface of deck plate 12. The bevel may be formed, for example, by grinding each edge 22 before, during, or after roll-forming each rib 14 from sheet material. The rib spacing in the lateral (i.e. width) direction of deck panel 10 may be determined based on the total number of ribs 14 needed and the overall width of deck panel 10 so that the ribs are evenly distributed across the underside of deck plate 12.

Concrete deck layer 15 may be coupled to deck plate 12 by a plurality of shear studs 26, and may include rebar reinforcement 28. The thickness of concrete deck layer 15 may be the minimum thickness required for mitigating fatigue cracking of the rib to deck plate welds 24. Determination of a suitable thickness for concrete deck layer 15 may be guided and informed by finite element analysis (FEA) modeling of deck panels 10 having various thicknesses of concrete deck layer 15. As a non-limiting example, a concrete deck layer thickness on the order of eight inches is contemplated.

Deck panels 10 may be manufactured in whole or in part at one or more manufacturing facilities remote from the bridge construction site, and then shipped to the construction site for completion (if necessary) and installation. For example, deck plate 12 may be cut to size, shear studs 26 may be installed on deck plate 12, ribs 14 may be roll-formed and cut to length, and ribs 14 may be welded to an underside of the deck plate at a steel fabrication facility having the necessary machine tools, cold roll-forming lines, and welding capability and fixtures. Deck panels 10 may be completed at the same or another facility by pouring concrete deck layer 15 to its full specified thickness and curing the poured concrete in a controlled environment. The completed deck panels 10 may then be shipped to the bridge construction site for installation.

In a second example, deck panels 10 may be manufactured as described in the first example above, except that the concrete deck layer 15 is partially poured (i.e. poured to a thickness that is a portion of the full specified thickness) and cured at an off-site facility, and then the partially completed deck panel is shipped to the bridge constructions site where the remainder of the concrete deck layer 15 may be poured and cured.

In a third example, metal components of deck panel 10 (i.e. deck plate 12, ribs 14, and shear studs 26) may be fabricated and welded at an off-site facility to form a subassembly, which may then be shipped to the bridge construction site, where the entire concrete deck layer 15 may be poured and cured.

As will be understood, the first example described above provides greater control over the entire manufacturing process by removing weather conditions, whereas the second and third examples facilitate shipping by reducing transport weight.

The present disclosure advances short span bridge construction by providing simplified steel orthotropic deck bridge panels which avoid costly details and design complexities that are unnecessary for short span applications. Moreover, the present disclosure allows for development of standardized orthotropic deck panels for short span applications, thereby leading to greater uniformity and certainty in costs to owners and contractors. This, in turn, provides opportunity to achieve cost savings from economies of scale. The present disclosure fills the void left by the current lack of "off the shelf" or "catalogue" orthotropic deck designs. In accordance with the present disclosure, standard orthotropic deck designs may be developed so that owners looking for a short span bridge solution or a bridge deck solution will have a limited set of choices. The standard designs may be characterized by predetermined calculations and performance ratings to make the decision process easier and give engineers confidence in the chosen design.

While the disclosure has been described in connection with exemplary embodiments, the detailed description is not intended to limit the scope of the disclosure to the particular forms set forth. The disclosure is intended to cover such alternatives, modifications and equivalents of the described embodiments as may be apparent to one of ordinary skill in the art.

What is claimed is:

1. An orthotropic deck panel comprising:

a steel deck plate having a topside and an underside;

a plurality of elongated steel ribs welded to the underside of the deck plate to extend in a longitudinal direction of the orthotropic deck panel; and, a concrete deck layer applied to the topside of the deck plate;

wherein each of the plurality of elongated steel ribs includes a pair of bends extending in a longitudinal direction of the rib, a bottom wall between the pair of bends, and a pair of side walls each extending from a respective one of the pair of bends and terminating at a corresponding edge;

wherein each of the plurality of elongated steel ribs is formed from sheet material having a thickness, and an inner radius of each of the pair of bends is about two times the thickness of the sheet material;

wherein the pair of bends are formed by a cold roll-forming process.

2. The orthotropic deck panel according to claim 1, wherein the plurality of elongated steel ribs include a camber introduced during the cold roll-forming process.

3. The orthotropic deck panel according to claim 1, further comprising a plurality of studs fixed to the topside of the deck plate for coupling the concrete deck layer to the deck plate.

4. A method of manufacturing an orthotropic deck panel comprising:

providing a steel deck plate having a topside and an underside;

cold roll-forming steel sheet material to form a plurality of elongated ribs, wherein each of the plurality of elongated ribs includes a pair of bends extending in a longitudinal direction of the rib, a bottom wall between the pair of bends, and a pair of side walls each extending from a respective one of the pair of bends and terminating at a corresponding edge;

welding the plurality of elongated ribs to the underside of the steel deck plate such that the plurality of elongated ribs extend in a longitudinal direction of the orthotropic deck panel; and pouring a concrete deck layer on the topside of the deck plate and curing the concrete deck layer;

wherein the method further comprises grinding the edges of the plurality of elongated ribs such that the edges rest in flush surface-to-surface engagement with the underside of the deck plate.

5. A method of manufacturing an orthotropic deck panel comprising:

providing a steel deck plate having a topside and an underside;

cold roll-forming steel sheet material to form a plurality of elongated ribs, wherein each of the plurality of elongated ribs includes a pair of bends extending in a longitudinal direction of the rib, a bottom wall between the pair of bends, and a pair of side walls each extending from a respective one of the pair of bends and terminating at a corresponding edge;

welding the plurality of elongated ribs to the underside of the steel deck plate such that the plurality of elongated ribs extend in a longitudinal direction of the orthotropic deck panel; and pouring a concrete deck layer on the topside of the deck plate and curing the concrete deck layer;

wherein the steel sheet material has a thickness, and an inner radius of each of the pair of bends is about two times the thickness of the sheet material.

6. The method according to claim 5, further comprising introducing a camber in each of the plurality of elongated ribs during the step of cold roll-forming steel sheet material.

7. The method according to claim 5, wherein the step of pouring the concrete deck layer is performed partially at a facility remote from a construction site where the orthotropic deck panel is used to construct a bridge and partially at the construction site.

8. The method according to claim 5, further comprising attaching studs to the topside of the deck plate prior to the step of pouring the concrete deck layer.

9. The method according to claim 5, wherein at least some of the steps of the method are performed at one or more facilities remote from a construction site where the orthotropic deck panel is used to construct a bridge.

10. The method according to claim 9, wherein all of the steps of the method are performed at one or more facilities remote from the construction site.

11. The method according to claim 9, wherein the steps of providing a steel deck plate, cold roll-forming steel sheet material, and welding the plurality of elongated ribs are performed at the one or more facilities remote from the construction site, and the step of pouring the concrete deck layer and curing he concrete deck layer is performed at the construction site.

* * * * *